United States Patent [19]

More et al.

[11] Patent Number: 4,982,626

[45] Date of Patent: Jan. 8, 1991

[54] HYDRAULIC TORQUE WRENCH

[75] Inventors: Nicholas More, Felton; Ian C. Thompson, Cramlington; John N. Walton, Whitley Bay, all of England

[73] Assignee: Hedley Purvis Limited, Morpeth, England

[21] Appl. No.: 476,324

[22] Filed: Feb. 7, 1990

[30] Foreign Application Priority Data

Feb. 7, 1989 [GB] United Kingdom ..... 8902659

[51] Int. Cl.[5] ..... B25B 13/46

[52] U.S. Cl. ..... 81/57.39

[58] Field of Search ..... 81/57.39

[56] References Cited

U.S. PATENT DOCUMENTS 4,765,210 8/1988 Merbach et al. ..... 81/57.39

4,825,730 5/1989 Junkers ..... 81/57.39

*Primary Examiner*—James G. Smith

*Attorney, Agent, or Firm*—Cushman, Darby & Cushman

[57] ABSTRACT

A hydraulic torque wrench comprises a body member housing a piston-cylinder assembly and a drive member pivotal by the piston of the assembly about an axis radially spaced from the line of action of the piston, the drive member carrying a shaft or socket connected to the drive member by a ratchet connection. A spherical bearing member is mounted to the end of the piston for guided linear reciprocal movement therewith, a neck portion of the drive member being slidably received in a bore in the bearing member whereby, as the drive member is pivoted by movement of the piston, the neck portion of the drive member undergoes guided sliding movement in the bore of the bearing member, the bearing member rotating relative to the piston such that the perpendicular distance between the line of action of the piston and the pivot axis remains constant.

8 Claims, 3 Drawing Sheets

A
A
4
8
22
24
30
34

2
6
10
14
16
20
22
28
12
8
30a
31
4
26
38
32
36
34
P
30
18
40
41

HYDRAULIC TORQUE WRENCH

BACKGROUND OF THE INVENTION

This invention relates to hydraulic torque wrenches used for rotating mechanical components, for example for tightening or loosening nuts, bolts and screws.

Hydraulic torque wrenches commonly comprise a hydraulic piston-cylinder assembly the free end of the piston of which is pivotally connected to a drive lever or levers rotatable by the piston-cylinder assembly about an axis radially spaced from the pivot connection. The drive lever or levers carries holding means for the component to be turned, said holding means being rotatable co-axially with the drive lever or levers and being connected to said drive lever or levers by a ratchet. The holding means may comprise a shaft carrying a removable socket or a socket within the drive lever or levers.

In most known arrangements, the drive lever oscillates in an arc about the axis of the holding means and the distance between the line of action of the piston rod and said axis varies throughout the oscillation. In theory, when a constant force is applied, the torque exerted on the holding means is proportional to this distance.

In order to minimize inaccuracies, the stroke of the piston is kept quite short about top-dead-center, typically such as to rotate the holding means through an angle of the order of 10° and whereby the arcing of the pivot point of the drive lever with the piston can be considered as substantially linear.

However it is an inherent feature of such designs that the distance between the line of action of the applied force and the axis of the holding means does vary slightly during the piston stroke, and the torque values calculated for a given hydraulic pressure can only be guaranteed within certain limits.

Further, the requirement to utilise a short piston stroke in an attempt to maintain accuracy means that a tightening operation can be a time consuming exercise.

SUMMARY OF THE INVENTION

It is an object of the invention to provide a hydraulic torque wrench producing a substantially constant torque and capable of maintaining such a torque over a relatively long stroke of the associated piston.

According to the present invention there is provided a hydraulic torque wrench comprising a body member in which is linearly reciprocable the piston of a hydraulic piston-cylinder assembly, a drive member pivotal by said piston-cylinder assembly about an axis radially spaced from the line of action of the piston, holding means carried by the drive member to be rotatable co-axially with said drive member, and a ratchet connection between the drive member and the holding means, characterised by a spherical bearing member mounted at or adjacent the free end of the piston to undergo guided linear reciprocal movement with the piston within the body member, the drive member including a neck portion radially remote from said pivot axis and slidably received within a bore in said spherical bearing member, the arrangement being such that, as the drive member is pivoted on linear movement of the piston and attached spherical bearing member, the neck portion of the drive member undergoes guided sliding movement in the bore of the bearing member, which bearing member rotates relative to the piston, the perpendicular distance between the line of action of the piston and said pivot axis remaining constant.

Preferably the torque wrench includes a shuttle member secured to the free end of the piston to undergo guided linear reciprocal movement with the piston within the body member, the spherical bearing member being mounted in the shuttle member and centered on the line of action of the piston.

Conveniently the shuttle member is of generally cylindrical shape and is reciprocal within a corresponding cylindrical bore formed within the body member.

The body member may be bored to receive therein said hydraulic piston-cylinder assembly, or, alternatively, the body member may comprise the cylinder of said assembly.

The body member is preferably of generally tubular form and includes a one end extent which is externally-splined to receive thereon a removable reaction arm or a removable reaction foot, said one end extent housing the piston of the piston-cylinder assembly, and an other end extent which is externally-splined and which houses the spherical bearing member, a housing containing the holding means and the ratchet connection being removably mounted on said other end extent of the body member.

Conveniently the body member has associated therewith two alternative housings, one containing a holding means in the form of a conventional polygonal drive shaft and associated sockets, and the other housing containing a holding means in the form of a polygonal socket.

DESCRIPTION OF THE PREFERRED EMBODIMENTS

Figure 2:
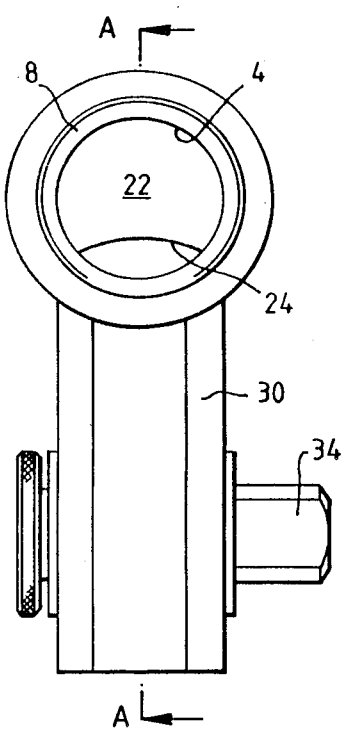
FIG. 2 is a front view of the wrench of FIG. 1.
Figure 1:
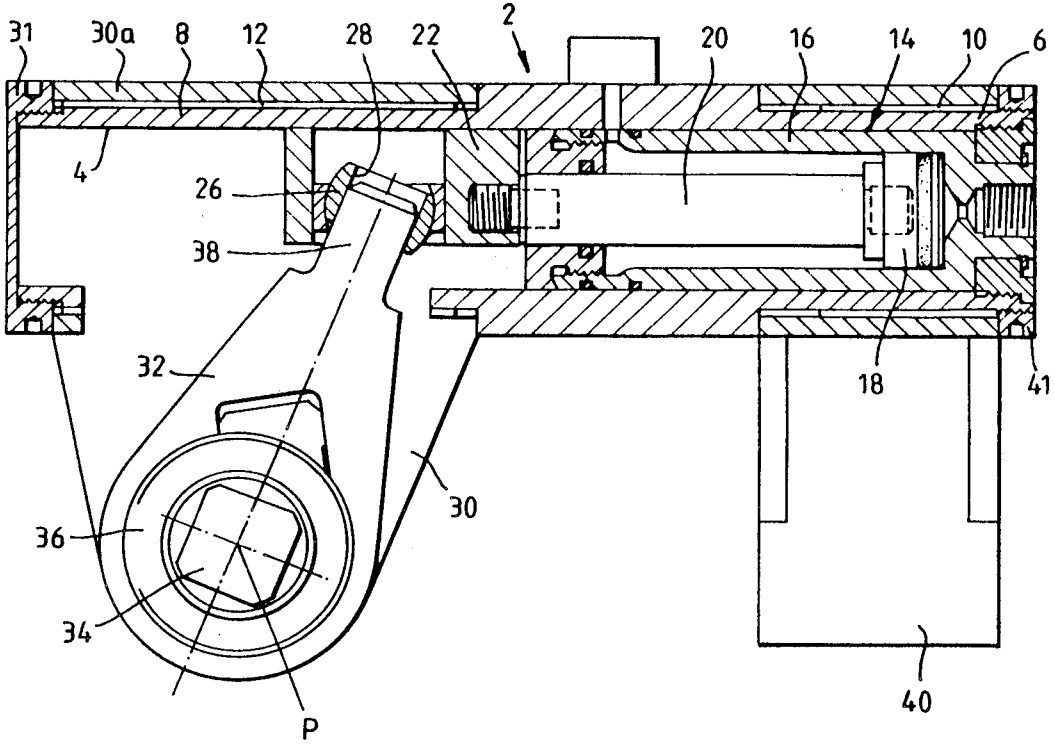
FIG. 1 is a longitudinal vertical section on the line A—A of FIG. 2 through a first torque wrench according to the invention.

Referring to FIGS. 1 and 2 of the drawings, the illustrated torque wrench comprises a tubular body member indicated generally at 2 in which is machined a cylindrical bore 4. The body member 2 includes a first end portion 6 of reduced external diameter and a second end portion 8 also of reduced external diameter, said portions 6 and 8 being externally-splined at 10 and 12 respectively for reasons which will become apparent.

A hydraulic piston-cylinder assembly indicated generally at 14 is located in one end of the bore 4 of the body member 2, said assembly comprising a cylinder 16 within the body member 2 and held in the body member so that, in use of the wrench, there is no relative axial movement between the cylinder 16 and the body member 2. A piston 18 carrying a piston rod 20 is slidably mounted in the cylinder 16 in conventional manner.

Secured, for example by screwing, to the free end of the piston 20 is a shuttle member 22 of generally cylindrical shape and guided for sliding movement in the bore 4. The shuttle member 22 is provided with a longitudinal slot 24 in the lower regions thereof for reasons which will become apparent. The arrangement is such that the shuttle member 22 reciprocates with the piston 18 and is positively guided during its linear reciprocating movement by co-operation with the bore 4.

The shuttle member 22 houses a spherical bearing member 26 provided with a cylindrical bore 28 therethrough, said bearing member being universally pivotal within the shuttle member 22 about a point on the line of action of the piston 18.

The wrench further includes a housing 30 including an internally-splined cylindrical portion 30*a* adapted to be positioned over the second end portion 8 of the body member 2 to locate the housing 30 in its operative position. The housing 30 is retained on the second end portion 8 of the body member 2 by means of an internally-threaded end cap 31 screwed onto the end of the portion 8.

The housing 30 contains therein the drive mechanism of the wrench. More particularly, this mechanism comprises a pivotal drive lever 32 in which is housed a square drive shaft 34, a ratchet 36 interconnecting the lever 32 and shaft 34 in conventional manner. The lever 32 and shaft 34 are pivotal about the point P.

The drive lever 32 includes, at a region remote from the point P, a cylindrical neck portion 38 the central axis of which extends radially of the pivot point P. Said neck portion 38 is received within, to be a sliding fit in, the bore 28 of the spherical bearing member 26 and effects the connection between hydraulic piston-cylinder assembly 14 and the drive mechanism.

A removable, internally-splined reaction arm 40 is mounted on the first end portion 6 of the body member 2, and is retained thereon by an internally-threaded end ring 41 screwed onto the end of the portion 6.

On movement of the piston 18 to the left as viewed in FIG. 1 in the cylinder 16, the shuttle member 22 and bearing member 26 therein are moved linearly carrying with them the neck portion 38 of the drive lever 2. The lever 32 is constrained to pivot about the point P, and the neck portion 38, as it arcs about the point P, moves radially upwardly and then downwardly relative to the line of action of the piston 18, this arcing movement of the neck portion 38 being accommodated by the bearing member 26 which swivels in its mounting in the shuttle member 22 about said point on the line of action of the piston 18. During this pivotal movement of the drive lever 32, the neck portion 38 slides within the bearing 26 along the axis of the bore 28 therein, the slot 24 in the shuttle member 22 accommodating the linear component of this movement of the neck portion 38.

The ratchet 36 between the drive lever 32 and the shaft 34 ensures that the shaft 34 is rotated with the lever 32 on anti-clockwise rotation of the lever 32 as viewed in FIG. 1 and remains stationary during return clockwise rotation of the lever 32, all in conventional manner.

Figure 5:
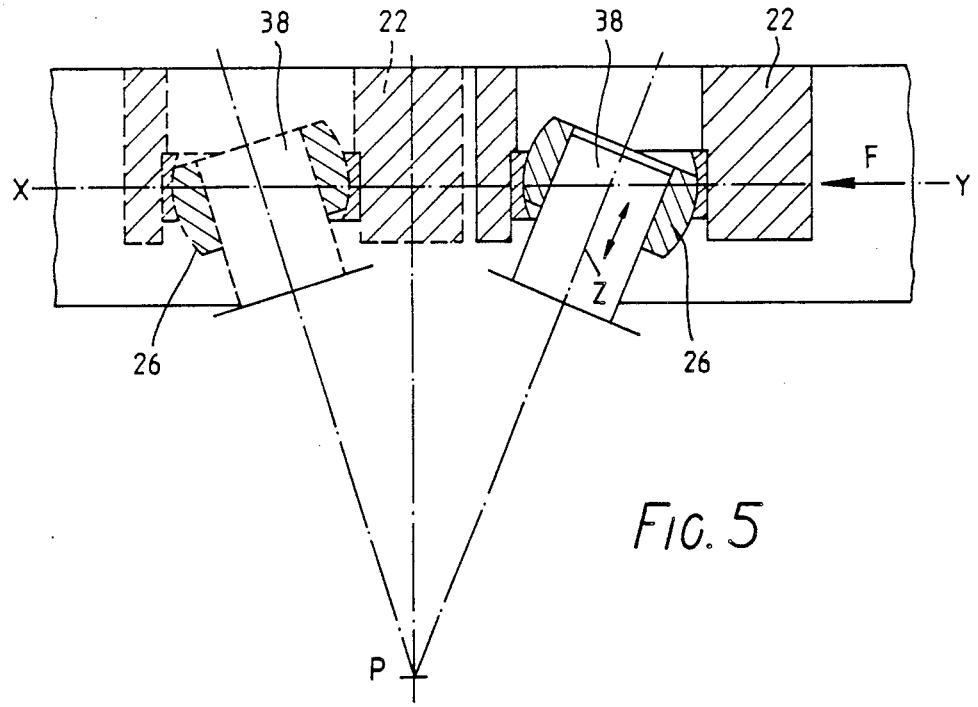
FIG. 5 illustrates the position of the shuttle member and spherical bearing member of the wrenches of FIGS. 1 to 4 at the extremities of their reciprocating movement.

FIG. 5 illustrates the shuttle member 22 and neck portion 38 of the drive lever 32 at both the beginning and the end of the power stroke of the piston, the shuttle member 22 being shown in full lines in its position at the beginning of the power stroke, and in dotted lines in its position at the end of said stroke, The force F supplied by the piston-cylinder assembly acts along the line X-Y which passes centrally through the spherical bearing member 26. The arrow Z shows the direction of the sliding movement of the neck portion 38 in the bearing 26.

Figure 6:
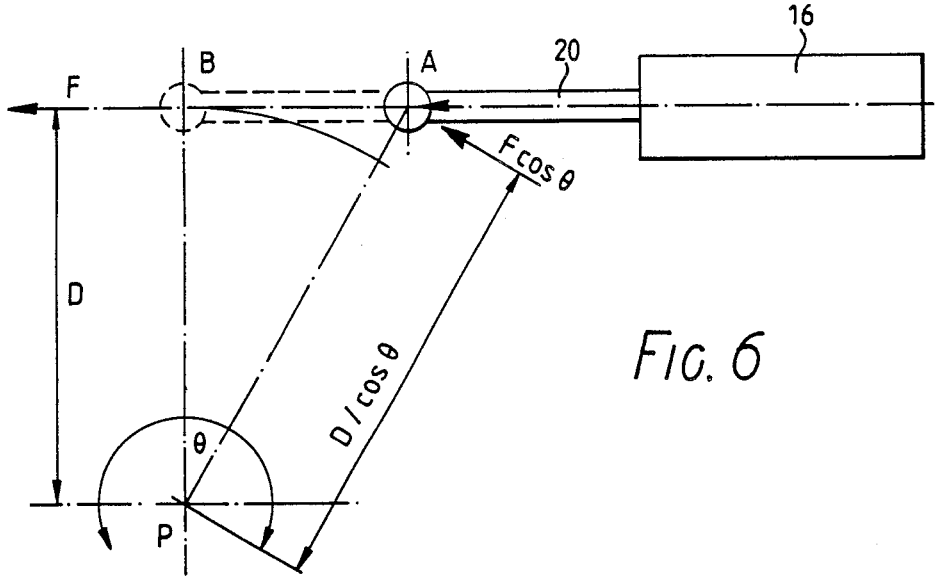
FIG. 6 illustrates schematically the principle of constant torque embodied in the wrenches of FIGS. 1 to 4.

FIG. 6 illustrates the concept of constant torque as provided by the wrench of FIGS. 1 and 2. Referring to FIG. 6, D is the perpendicular distance between the line of action X-Y of the piston 18 and the pivot point P, A is the position of the bearing 26 at the beginning of the power stroke and B is the position of the bearing 26 with the lever 32 perpendicular to the line of action X-Y. The piston-cylinder assembly 14 provides a constant output force F which acts along the line X-Y.

The line AP makes an angle of $\theta$ with the vertical BP and consequently the component of the force F acting at A about the point P is equal to F cos $\theta$. The perpendicular distance between this component of the force F and the point P is $$\frac{D}{\cos\theta}.$$

. As torque is equal to force x distance, the torque about the point P with the bearing 26 at the position A is F cos $\theta \times$ $$\frac{D}{\cos\theta}$$

which is equal to $F \times D$.

Thus it will be appreciated that, for a given force F, the piston-cylinder arrangement 14 provides a substantially constant torque about the point P throughout its stroke, the provision of the spherical bearing member 26 and the sliding arrangement with the neck portion 38 maintaining constant the line of action of the force F on the lever 32.

Figure 4:
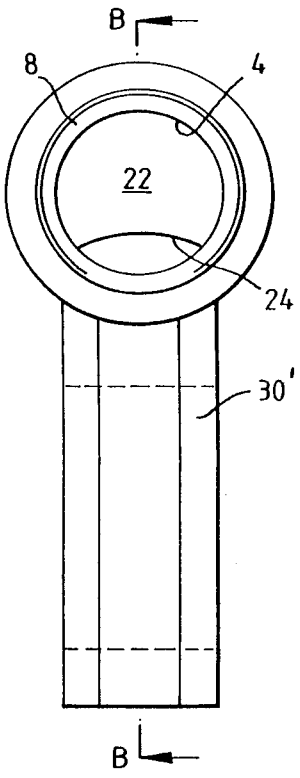
FIG. 4 is a front view of the wrench of FIG. 3.
Figure 3:
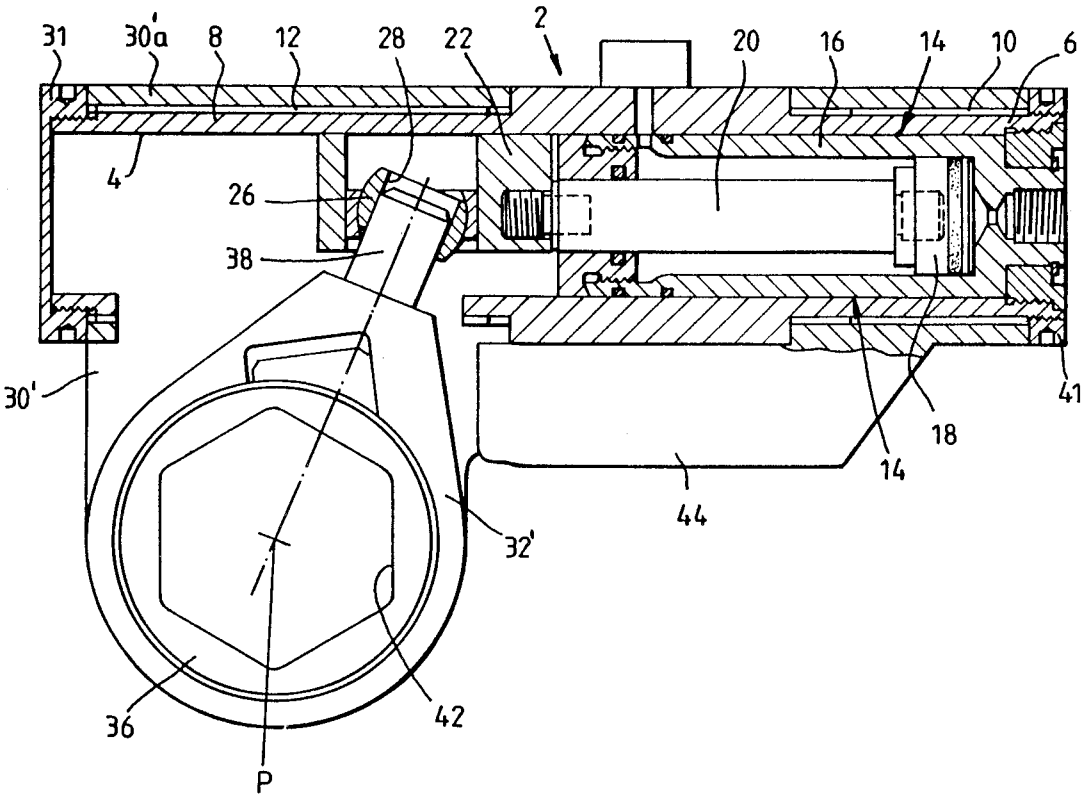
FIG. 3 is a longitudinal vertical section on the line B—B of FIG. 4 through a further torque wrench according to the invention.

FIGS. 3 and 4 illustrate an alternative embodiment of the invention in which components equivalent to those in FIGS. 1 and 2 are similarly referenced.

The housing 30 is replaced by an alternative housing 30' which also fits over the splines 12, this particular housing 30' converting the wrench from its conventional polygonal-drive mode to a slim-line mode.

More particularly, the housing 30' includes a pivotal drive lever 32' in which is housed a hexagonal socket 42, a ratchet 36' interconnecting the lever 32' and socket 42 in conventional manner. The lever 32' and socket 42 are pivotal about the point P.

The principle of the operation of the wrench of FIGS. 3 and 4 is exactly the same as that of the wrench of FIGS. 1 and 2, the inter-changeability of the housings 30,30' and their associated drive mechanisms clearly extending the usefulness of the basic body member 2.

The housing 30' embodies a reaction foot 44 which, like the reaction arm 40, is internally-splined for location on the external splines 10 of the first end portion 8 of the body member 2 to be located to co-operate, in use of the tool, with an adjacent abutment, the arrangement being such that, unlike other slim-line tools, there is no need to incorporate rollers for co-operation with the periphery of the associated flange or the like, as the wrench remains stationary throughout the tightening or loosening procedure. Thus the tool can be used in very confined spaces.

Thus there are provided hydraulic torque wrenches providing substantially constant torques, the wrenches being of relatively simple construction and, in view of the interchangeability of the housing 30,30', having extensive applications. In particular, the length of the piston stroke is substantially increased compared with that of known arrangements, the provision of the spherical bearing 26/ drive leaver 32,32' arrangements as described ensuring that the torque remains substantially constant throughout the increased stroke, resulting in quicker, more accurate operations.

What we claim and desire to secure by letters Patent is:

1. A hydraulic torque wrench comprising:

a body member, a hydraulic piston-cylinder assembly having a piston capable of linear reciprocation within the body member, said piston having a free end and a line of action, a drive member rotable relative to said piston-cylinder assembly having an axis of rotation radially spaced from the line of action of the piston, holding means carried by the drive member, a rachet connection between the drive member and the holding means, said ratchet connection being centered on said axis of rotation, and a spherical bearing member mounted to the free end of the piston capable of undergoing guided linear reciprocal movement with the piston within the body member, the bearing member including means for defining therein a bore, the drive member including a neck portion at an end radially remote from said axis of rotation, said neck portion being slidably received within the bore in said spherical bearing member, the arrangement being such that, as the drive member is rotated by linear movement of the piston and attached spherical bearing member, the neck portion of the drive member undergoes guided sliding movement in the bore of the bearing member, which bearing member rotates relative to the piston, thereby causing the perpendicular distance between the line of action of the piston and said axis of rotation to remain constant.

2. A wrench as claimed in claim 1 and further including a shuttle member secured to the free end of the piston to undergo guided linear reciprocal movement with the piston within the body member, the spherical bearing member being mounted in the shuttle member and centered on the line of action of the piston.

3. A wrench as claimed in claim 2 in which the shuttle member is of generally cylindrical shape, the body member defining therein a corresponding cylindrical bore, the shuttle member being reciprocal within said bore within the body member.

4. A wrench as claimed in claim 1 in which the body member is bored to receive therein the hydraulic piston-cylinder assembly.

5. A wrench as claimed in claim 1 in which the body member comprises the cylinder of the hydraulic piston-cylinder assembly.

6. A wrench as claimed in claim 1 in which the body member is of generally tubular form and further includes a one end extent which is externally-splined, a removable reaction member being received on said one end extent of the body member, said one end extent containing the piston of the piston-cylinder assembly, and an other end extent which is externally-splined and which contains the spherical bearing member, the wrench further comprising a housing containing the drive member, the holding means and the ratchet connection, the housing being removably mounted on said other end extent of the body member.

7. A wrench as claimed in claim 6 wherein the holding means is a polygonal drive shaft.

8. A wrench as claimed in claim 6 wherein the holding means is a polygonal socket.

* * * * *

UNITED STATES PATENT AND TRADEMARK OFFICE

CERTIFICATE OF CORRECTION

PATENT NO. : 4,982,626

DATED : January 8, 1991

INVENTOR(S) : More et al

It is certified that error appears in the above-identified patent and that said Letters Patent is hereby corrected as shown below:

Please change:

"Column 4, Lines 21 to 27, bearing 26 at the position A is F cos $\theta$ x $\frac{D}{\cos \theta}$ which is equal to F X D." to -- Column 4 Lines 21 to 27, bearing 26 at the point A is F cos $\theta$ X $\frac{D}{\cos \theta}$ which is equal to F X D.---

Signed and Sealed this

Twenty-fifth Day of August, 1992

*Attest:*

DOUGLAS B. COMER

*Attesting Officer*

*Acting Commissioner of Patents and Trademarks*